United States Patent [19]

Giuffré et al.

[11] Patent Number: 4,663,012

[45] Date of Patent: May 5, 1987

[54] SEPARATOR FILM FOR THE ALKALINE ELECTROLYSIS CONTAINING POLYTITANIC ACID

[75] Inventors: Luigi Giuffré; Giovanni Modica; Silvia Maffi; Ezio Tempesti, all of Milan; Giancarlo Pierini, Varese, all of Italy

[73] Assignee: European Atomic Energy Community, Plateau du Kirchberg, Luxembourg

[21] Appl. No.: 816,775

[22] Filed: Jan. 7, 1986

[30] Foreign Application Priority Data

Jan. 7, 1985 [LU] Luxembourg ..... 85723

[51] Int. Cl.[4] ..... C25B 13/08

[52] U.S. Cl. ..... 204/296; 521/53; 521/55; 521/145

[58] Field of Search ..... 204/296; 521/53, 55, 521/145

[56] References Cited

U.S. PATENT DOCUMENTS 4,111,866 9/1978 Torikai et al. ..... 204/296
4,326,914 4/1982 Höhne ..... 204/296

FOREIGN PATENT DOCUMENTS 0061200 5/1977 Japan ..... 204/296

*Primary Examiner*—Terryence Chapman
*Attorney, Agent, or Firm*—Sughrue, Mion, Zinn, Macpeak and Seas

[57] ABSTRACT

Separator film for alkaline electrolysis and method for making thereof, wherein said separator film includes an aromatic polymer and polytitanic acid.

5 Claims, No Drawings

SEPARATOR FILM FOR THE ALKALINE ELECTROLYSIS CONTAINING POLYTITANIC ACID

The invention concerns a separator film for the alkaline electrolysis and a method for manufacturing such a film.

A separator material intended for the alkaline electrolysis of natural water, heavy water or tritiated water must primarily be chemically stable with respect to alkaline solutions and with respect to a beta radiation. Moreover, this separator must be wettable without difficulties. This last mentioned item is important in order to avoid the formation of gaseous bubbles in the separator which would increase the voltage drop and the mixing of the gases.

The hydrogen isotopic separation by electrolysis is based on the different cathodic potential discharges. In order to obtain pure cathodic gases, it is necessary to avoid any mixture with the anodic gas constituted by oxygen. Known separators achieve this result by using different types of material. The asbestos separators, usually employed in the alkaline electrolysis of natural water up to a temperature of 80° C., do not resist tritiated water. In fact, an isotopic exchange between hydrogen and tritium occurs in the hydrate magnesium polysilicate chains which constitute the polymeric skeleton of this material. The exchanged tritium then decayes "in situ" in the structure of the asbestos with an emission of beta radiation and a conversion to helium gas. This action, which occurs practically in all the points of the fibrous structure provokes the rapid destruction of the asbestos.

In the frame of the search for other materials adequate for separator films, inorgnic polymer materials have also been investigated. These materials present a very high chemical inactivity and a good wettability even under the conditions of alkaline electrolysis. These products, however, cannot be simply prepared in fibrous form or as microporous films, as their aggregation state is generally pulverulent or microporous. Among the organic polymer materials, only a few are resistent under the severe conditions existing in an alkaline electrolytic cell. Some of these materials, such as polytetrafluorethylene, polyphenylsulphide, polychinoxaline, polyphenylchinoxaline and polyphenylene show an acceptable chemical stability, but their wettability is not sufficient for the considered application.

Further studies were carried out on polysulphone which is a fibrous product or a microporous film. Even in this case, the formation of gaseous bubbles occurs frequently inside the separator. Some attempts have been made with inorganic polymers such as for instance polytitanic acid in mixture with chemically resistent organic polymers such as polytetrafluorethylene, but after a short time, these mixtures lost their wettability because of the removal of the polytitanic acid which did not tie with the polytetrafluorethylene.

One object of the invention is to propose a new material for a composite separator including an organic binder and an inorganic polymeric ion exchanger. Such a material should resist to tritiated and present a high wettability.

This object is obtained according to the invention by a separator film which includes an aromatic polymer chosen from the group of compounds containing polysulphone, polyethersulphone and polybenzimidazole, and further includes polytitanic acid, the weight percentage of the latter in the composite material being chosen between 3 and 45, preferably between 5 and 30 percent.

A method for manufacturing such a film consists in dissolving an aromatic polymer chosen from the group of compounds containing polysulphone, polyethersulphone and polybenzimidazole in a solvent, in adding thereto titanium tetrabutanate, in pouring this solution on a plane support, in making the solvent disappear, in treating the film thus obtained with boiling water and in finally withdrawing this film from the support.

Another method for manufacturing such a film consists of treating titanium polybutanate with water in order to obtain polytitanic acid, then in mixing this compound with pulverulent polysulphone and finally in submitting this powder mixture to a heating and compression operation which results in the separator film.

Still another method for manufacturing such a film consists in treating titanium polybutanate with water, then in gaining polytitanic acid therefrom by filtering and drying, then in mixing the polyacid with a solution of polysulphone in a methylene chloride solvent and then in pouring this mixture on a plane support, whereafter the solvent is made to disappear and the film obtained thereby is finally withdrawn from the support.

Preferably, the solvent is methylene chloride and is made to disappear by evaporation.

The inorganic ion exchanger belongs to the family of the polytitanic acids having the general formula $TiO_2.nH_2O$. These polytitanic acids can be obtained by acid or alkaline hydrolysis of different alcoholates such as ethylate, butylate, cresilate, nonilate. Due to these acids, an excellent wettability and a great capacity for repelling gas bubbles are obtained. Another important point in favour of polytitanic acid is that it is capable of exchanging cations with the electrolyte.

The separators according to the invention are prepared as membranes which are impermeable to the electrolyte, or as porous diaphragms which are permeable to the electrolyte.

The composite separators according to the invention are highly resistent to mechanical abrasion and can be manufactured with a large structural stability which allows to obtain very thin separators. These two characteristics allow to maintain predetermined and small distances between the anode and the cathode and to increase the faradic efficiency.

As an unexpected result, it has been found that by mixing an organic polymer of the aromatic type with an inorganic polymer of polytitanic acid, a separator is obtained which is highly resistent to the alkaline medium and to mechanical abrasion. Moreover, it presents a high wettability in the presence of natural, heavy or tritiated water. Finally, the separator according to the invention allows to obtain very pure cathodic gases (purity rate higher than 99.99%).

By modifying the quantity of polytitanic acid present in the structure and by modifying the preparation method, separators of the most different characteristics can be formed. Moreover, it has been found that it is useful to mix with the composite material during the phase of preparation a polymeric compound such as polyethylene glycol, polypropylene glycol, the esters or ethers of cellulose, the polymaleic anhydride and in general any polymer or compound which can easily be dissolved in a solvent. By this additive, a porous structure of the composite materials is obtained after treatment in this solvent, the porosity of which depends on the amount of soluble polymeric compounds.

The invention will be described hereafter by means of some examples.

EXAMPLE 1

3 g of polysulphone are dissolved in 25 ml of methylene chloride by heating to 35° C. 3 ml of titanium tetrabutanate $Ti(OBu)_4$ are added to this solution. A clear solution is obtained, which is poured on a glass plate and left there until the solvent is evaporated. A film of 0.1 mm thickness is formed, which is treated with boiling water so as to convert the titanium butanate to polytitanic acid. This film, used as a separator in the alkaline electrolysis of water with 30% of KOH, presents a tension drop of 5.11 $\Omega cm^2$ at 30° C., 4.3 $\Omega cm^2$ at 50° C., 3.7 $\Omega cm^2$ at 65° C., 2.8 $\Omega cm^2$ at 80° C., and 2.3 $\Omega cm^2$ at 100° C.

The water regain rate, i.e. the ratio between the weight of the water and the total weight (water+film) is about 20.6%. The weight loss of this film after 1500 hours in KOH at 30% and at 125° C. is less than 5%.

This film, used as a separator in an alkaline electrolytic cell allows to produce a cathodic gas with a purity higher than 99.99%, even after 150 hours of operation. The other characteristics, such as the mechanical resistance and the separation rate of the gases, also remain inchanged. In this separator, the amount of titanium expressed as $TiO_2$ is 19% by weight.

EXAMPLE 2

3 g of polysulphone are dissolved in 30 ml methylene chloride at 35° C. 4.5 ml of $Ti(OBu)_4$ are added, and in the same way as described in example 1, a film with a thickness of 0.1 mm is treated in boiling water. This film, used as a separator in 30% KOH electrolytic cells, presents a tension drop of 2.9 $\Omega cm^2$ at 30° C., 2.6 $\Omega cm^2$ at 50° C., 2.06 $\Omega cm^2$ at 65° C., 1.83 $\Omega cm^2$ at 80° C. and 1.5 $\Omega cm^2$ at 100° C.

The water regain is 25% and the weight loss after 1500 hours in KOH (30%) at 125° C. is less than 1%. The cathodic gas obtained during the electrolysis presents a purity above 99.99%. All these characteristics remain unchanged even after 1500 hours of operation. The titanium content expressed as $TiO_2$ in this separator is 26%.

EXAMPLE 3

3 g of polysulphone are dissolved in 20 ml of N.methylpyrrolidone at 50°-60° C. 0.6 g of polyethylene glycol with an average molecular weight of 6000 and 3 ml of $Ti(OBu)_4$ are added to the solution. The polyethylene glycol is added in order to obtain a microporous controlled film after treatment with boiling water.

The clear solution is poured on a glass plate so as to form a uniform film of solution. This plate is bathed in water in a tank where the solvent (N-methylepyrrolidone) diffuses in the water with coagulum of the polymer and consequent formation of a solid film, after treatment with boiling water, as described in example 1, for converting the titanium butanate to polytitanic acid, and eliminating the polyethylene glycol from the film for the formation of the microporosity.

The separator film of a thickness of 0.08 mm has the following characteristics:

tension drop: 0.25, 0.16, 0.11 $\Omega cm^2$, respectively at 50°, 80°, 100° C., in KOH at 30%,
purity of cathodic gas: 99.99%,
water regain: 47.7%,
the Ti expressed as $TiO_2$ is 19% by weight.

After 1500 hours of operation, this separator maintains the same characteristics during the electrolysis.

EXAMPLE 4

With the same methodolgy as described in example 3, a film with a percentage of $TiO_2$ of 23% is prepared. The characteristics after 1500 hours of electrolytic operation remain the same. They are:

tension drop: 0.20, 0.13, 0.08 $\Omega cm^2$, respectively at 50°, 80°, 100° C. in KOH 30%.
water regain: 45.5%,
purity of cathodic gas: about 99.99%.

EXAMPLE 5

3 g of polysulphone are dissolved in 25 ml of methylene chloride at 35° C. Separately, 3 ml of $Ti(OBu)_4$ are treated at 100° C. with 30 ml of water, obtaining a thin and white precipitate of polytitanic acid which is recuperated by filtration, dried and added to the solution of polysulphone in methylene chloride.

A suspension of polytitanic acid is formed in the solution of polysulphone, which, after having been accurately homogeneized, is poured on a glass plate. With the same methodology as adopted in example 1, a film of 0.13 mm thickness is prepared.

After 1500 hours of electrolysis in 39% KOH solution, the characteristics of the film are the same, that is to say:

tension drop: 6.2, 5.4, 4.2, 3.6 $\Omega cm^2$, respectively at 30°, 50°, 65°, 80° C.,
water regain: 14.7%,
weight losses at 125° C.: 8%,
purity of cathodic gas: above 99.99%,
$TiO_2$ content: 19%.

EXAMPLE 6

3 g of polysulphone are accurately grinded and mixed with the needed quantity of polytitanic acid obtained by treating separately 3 ml of $Ti(OBu)_4$ with 30 ml of $H_2O$ as described in example 5.

This powder mixture is press-forged at 270° C. and 30 $kg/cm^2$ so as to obtain a film 0.1 mm thick. This film, used as a separator in the KOH 30% alkaline electrolysis of water, has the following characteristics:

tension drop: 6.3, 5.7, 4.7, 4.5 $\Omega cm^2$ at 30°, 50°, 65°, 80° C., respectively,
water regain: 14%,
weight loss after 1500 hours of electrolysis: 8.5%,
$TiO_2$ content: 19%,
purity of the cathodic gas: 99.99%.

We claim:

1. A separator film for the alkaline elctrolysis including an aromatic polymer selected from the group consisting of compounds containing polysulphone, polyethersulphone and polybenzimidazole, and further including polytitanic acid, the weight percentage of the polytitanic acid in the separator film being chosen between 3 and 45, preferably between 5 and 30%.

2. A method for manufacturing a separator film according to claim 1, comprising dissolving an aromatic polymer selected from the group consisting of compounds containing polysulphone, polyethersulphone and polybenzimidazole in a solvent, then adding titanium tetrabutanate thereto, then pouring this solution on a plane support, then removing the solvent and treating the film obtained thereby with boiling water and finally withdrawing the film from the support.

3. A method for manufacturing a separator film according to claim 1, comprising first treating titanium polybutanate with water to obtain polytitanic acid, then mixing said acid compound with pulverulent polysulphone to obtain a resultant powder and finally submitting the resultant powder to a heating and compression operation which results in the separator film.

4. A method for manufacturing a separator film according to claim 1, comprising first treating titanium polybutanate with water, then obtaining polytitanic acid therefrom by filtering and drying, then mixing the polytitanic acid with a solution of polysulphone in a methylene chloride solvent and then pouring the resultant mixture on a plane support, removing the solvent and withdrawing the film obtained thereby from the support.

5. A method according to claim 2 or 4, wherein the solvent is methylene chloride and is removed by evaporation.

* * * * *